United States Patent [19]

Goh et al.

[11] Patent Number: 4,881,918

[45] Date of Patent: Nov. 21, 1989

[54] COIN AND DISC SORTING

[75] Inventors: David Goh, Shropshire; Anthony M. Moran-Iturralde, Nottingham; Geoffrey Howells, Hampshire, all of England

[73] Assignee: Scan Coin AB, Malmo, Sweden

[21] Appl. No.: 158,268

[22] PCT Filed: Jun. 10, 1987

[86] PCT No.: PCT/GB87/00401

§ 371 Date: Mar. 21, 1988

§ 102(e) Date: Mar. 21, 1988

[87] PCT Pub. No.: WO87/07742

PCT Pub. Date: Dec. 17, 1987

[30] Foreign Application Priority Data

Jun. 12, 1986 [GB] United Kingdom ..... 8614279
Jun. 12, 1986 [GB] United Kingdom ..... 8614280

[51] Int. Cl.[4] ..... G07D 3/14

[52] U.S. Cl. ..... 453/4; 194/334; 453/56

[58] Field of Search ..... 453/3, 7, 11, 56, 32, 453/6, 10, 4; 194/334, 338; 209/586; 377/24

[56] References Cited

U.S. PATENT DOCUMENTS 3,680,566 8/1972 Tanaka et al. ..... 453/32 X
4,259,571 3/1981 Dubberly ..... 377/24 X
4,261,377 4/1981 Ueda ..... 453/32 X

FOREIGN PATENT DOCUMENTS 0200873 11/1986 European Pat. Off. .
1774214 6/1971 Fed. Rep. of Germany .
2123727 11/1972 Fed. Rep. of Germany .
2742317 3/1979 Fed. Rep. of Germany .
2800494 7/1979 Fed. Rep. of Germany .
3425030 1/1985 Fed. Rep. of Germany .
747558 4/1956 United Kingdom ..... 209/568
2121582 12/1983 United Kingdom .

*Primary Examiner*—F. J. Bartuska
*Attorney, Agent, or Firm*—Leydig, Voit & Mayer

[57] ABSTRACT

A high speed coin sorter of the belt type has an elongate plate (8') along which coins (12) to be sorted are carried in single file by a belt (1) which is driven by a pulley (2). A series of coin deflecting recesses (15 to 18) of hockey stick shape are formed in the upper surface (8) of the plate (8'), and in dependence upon the denomination of a coin, as determined by a coin discriminator (10, 11) positioned in advance of the recesses, the coins are selectively deflected from their straight line paths along the surface (8) by respective solenoid-actuated pins (19 to 22), such that a coin is pressed by the belt into the appropriate deflection recess corresponding to that coin denomination. A shaft encoder (4, 6) is associated with the belt drive pulley (2), and the signals from the encoder are used to track the progress of the coins along the surface (8) from the discriminator to provide a timing signal for projecting the appropriate deflection pin. The encoder signals may be used by the discriminator (10, 11) as the basis of a diameter measurement.

10 Claims, 2 Drawing Sheets

COIN AND DISC SORTING

This invention relates to coin or disc sorting equipment and particularly, but not exclusively, to equipment designed to operate at high speed.

For convenience the term "coin" will be used hereinafter to include a bogus coin or a disc.

Coin sorters have been proposed in which coins in single file are carried along a smooth horizontal support surface by a belt, the coins being held between the belt and the support surface, and the support surface is provided with apertures of different sizes under the path of the belt so that coins of different diameters fall through the appropriately sized apertures and are thereby sorted according to diameter.

Such sorters suffer from various disadvantages. Since they sort by diameter they will not, of course, distinguish between two different coins of the same diameter, which is a problem when coins from different countries are being handled, or when bogus coins or foreign coins are encountered in a batch of coins nominally of one country.

In one proposal (WO85/05478 of Zimmerman) an attempt is made to sort out bogus or foreign coins before the coins reach the sorting aperture by deflecting such coins into a reject aperture which is displaced to one side of the path of the belt in response to a reading from an optical coin testing means positioned immediately in advance of the deflecting device.

The present sorters of this type are relatively crude since they rely, apart from the rejection device, upon a mechanical testing arrangement.

Such sorters are limited as to the speed of operation, and therefore the numbers of coins that can be handled per unit time. This is because they rely largely on gravity to carry the coins though the apertures, that is to take a coin which has reached its corresponding aperture out of the path of the following coin which may need to proceed to a more distant aperture. As the speed of operation is increased it is possible for the following coin, which is being positively driven by the belt, to collide with the coin which is in the course of falling through the aperture, and which accordingly is not being driven by the belt.

According to one aspect of the invention a coin sorter comprises a support surface, a coin transport belt extending in proximity to the surface and arranged to carry coins trapped between the belt and the support surface along the surface, an encoder associated with the belt drive or belt to provide a signal representative of the position of a portion of the belt, means for feeding coins in serial manner to the belt, a coin measuring means positioned at a first location in the path of the belt, and at least one selectively operable coin deflection means located at a second location in the path of the belt downstream of the first location, and control means arranged such that, in response to a signal from the coin measuring means that requires the coin to be deflected by the deflection means, the deflection means is arranged to be active when the coin reaches the second location as determined from the encoder signal.

Thus the progress of the coin along the support surface is monitored by monitoring the encoder signals, and the deflection means can be arranged to be activated at the appropriate time.

Since in a high speed coin sorter, in which the aim is to send as many coins in a given time as possible along the support surface, there will often be several coins between the first and second locations, it will usually be necessary to ensure that the deflection means is not prematurely activated in order to ensure that only the correct coin is deflected. That is why the encoder is required to monitor the progress of the coins along the support surface.

Thus, it will be appreciated that positive action is being taken by the deflection means in response to an earlier measurement which is timed by monitoring the coins progress, as compared with the passive arrangement of sorters employing sorting apertures.

Usually a series of selectively operable coin deflectors will be provided which are selectively operated by the control system.

The control system is preferably reprogrammable to enable the destinations of different coin types in the sorter to be altered as required.

According to a second aspect of the invention a coin sorter comprises a belt which is arranged in proximity to a support surface, means for feeding coins to the belt in single file, the arrangement being such that when the belt is driven the coins are trapped between the belt and the support surface and are carried along the support surface by the frictional engagement between the belt and the coins, the support surface being provided with at least one recess of a depth such that a coin when in the recess is still substantially driven by the belt, the recess being bounded by a deflection wall which is shaped to deflect a coin which is engaged with the deflection wall out of the path of the belt to a coin receiving means, the arrangement being such that coins being driven by the belt are transversely positioned prior to reaching the recess, or at the recess, in response to a measurement made by a coin measuring means such that selected coins can be pressed into the recess by the belt for deflection by the deflection wall.

It will be appreciated that with this arrangement the recess provides the coin deflecting action which was performed by an aperture in the known arrangement, and since the coin is still being driven by belt whilst it is in the recess and in the path of the belt there is a much reduced chance of a collision with the following coin which may be proceeding further along the belt.

The means for selectively positioning the coins transversely of the belt in response to the output of the measuring means is preferably located at the recess.

The measuring means can utilise any number of coin measuring techniques, so that the selection of the coins to be deflected can be made as critical or as course as is required.

The positioning means can comprise a relatively small projection such that its inertia can be made small, thereby facilitating rapid movement of the projection to facilitate high speed sorting.

Preferably the projection is in the form of a pin which is retractable substantially axially of the support surface by suitable means, such as a solenoid, preferably located beneath the support surface.

In order to sort more than two types of coins the support surface is preferably formed with a plurality of such recesses, arranged in series along the belt path, and each recess preferably has an associated positioning means responsive to the coin measuring means.

The operation of the positioning means in response to the measurements of the coin measuring means is preferably under the control of a programmable control means which can be programmed to arrange for types of coins as chosen by the user to be deflected at chosen recesses. In some coinages there can be distinctly different coins having the same value, and it is possible to program the control means such that both types of that coin are deflected into the same collection means even though their characteristics as measured by the coin measuring means are different.

The coin measuring means can be, for example, an inductive, capacitative, magnetic, optical or any other type or combination of sensors.

The shape of the deflection wall, as viewed normal to the support surface can be chosen to direct the coins in almost any desired direction away from the path of the belt. This provides substantially greater freedom as to the positioning and arrangement of the coin receiving means as compared with the known sorters in which the coins fall through apertures in the support surface and accordingly are all directed roughly downwards.

Each recess is preferably of substantially wedge-shape in transverse cross-section and of substantially hockey stick or j-shape as viewed in plan.

The coins can be fed to the belt by any convenient means, conveniently by a disc feeder supplied from a hopper.

Usually it will not be possible to locate the coin measuring means closely adjacent to the coin deflecting recess and it will be desirable to locate the coin measuring means at some position in advance of the coin deflecting recess. When, as will usually be the case, there are several coil deflecting recesses arranged in series, it will be desirable to operate the respective transverse positioning means in response to measurements made by a common coin measuring means positioned in advance of all of the coin deflecting recesses. It will be desirable in these cases to monitor the progress of the coins along the support surface using an encoder, in accordance with the first aspect of the invention.

An additional advantage of using an encoder to measure the displacement of the belt is that, if desired, the encoder signals can also be used as a basis for measuring the diameter of a coin.

There have, of course, been numerous proposals for coin discriminators. Discriminators which rely upon mechanical tests on coins are generally severely limited as to the speed at which they can operate. Discriminators which rely upon the measurement of the electrical and magnetic properties of the coin tend to be expensive and can place heavy demands upon the computing capacity of a microprocessor unit which is used in conjunction with the measuring transducer to analyse the results of the measurements. Many coin discriminators require the coin to be accurately positioned relative to a datum surface whilst the coin is being measured, and such accurate positioning is not easy to produce when coins are passing through the discriminator at high speed, since they tend to bounce off the datum surface, and this difficulty limits the accuracy/speed of coin feeding.

Preferably the coin measuring means of a coin sorter in accordance with the first aspect of the invention comprises a detector adapted to respond to the passage of an identifiable element of the coin past the detector, and means adapted to compute from the output of the encoder the longitudinal displacement of the belt which takes place in the period between two signals from the coin detector/s.

In some arrangement the two signals can be signals from the same detector, whereas in other arrangements the two signals are signals from different detectors.

The identifiable element is preferably an edge of the coin, but it may be another element, such as the maximum width of the coin when the coin is viewed face on.

The detector preferably utilises electromagnetic waves, preferably infra-red light.

The detector preferably comprises a light emitter and a light detector positioned on opposite sides of the coin path.

In the most straightforward arrangement the discriminator is arranged to measure the coin diameter, the wave emitter and detector being positioned such that the direction of propagation of the waves therebetween is transverse to the coin path and substantially parallel to the plane of the belt. It will be appreciated that, providing there is no slippage between the belt and the coin, the belt will have been displaced by precisely the diameter of the coin in the period between successive signals from the wave emitter corresponding to the passing of the front and rear edges of the coin past the detector.

Since it is only the edge of a coin which is being detected, it is possible to have only a small spacing between adjacent coins, as compared with discriminators which measure electrical or magnetic characteristics of the coins where closely adjacent coins would affect the measurements; and accordingly the feed rates can be higher than with electrical or magnetic discriminators.

According to a third aspect of the invention a coin discriminator comprises a coin transport belt adapted to convey coins past one or more detectors, the coins being carried by the friction between the belt and one face of the coin, the detector being adapted to respond to the passage of an identifiable element of the coin past the detector, and means adapted to measure the longitudinal displacement of the belt which takes place in the period between two signals from the coin detector/s.

A coin sorter in accordance with the invention will now be described, by way of example only, with reference to the accompanying drawings in which.

Figure 2:
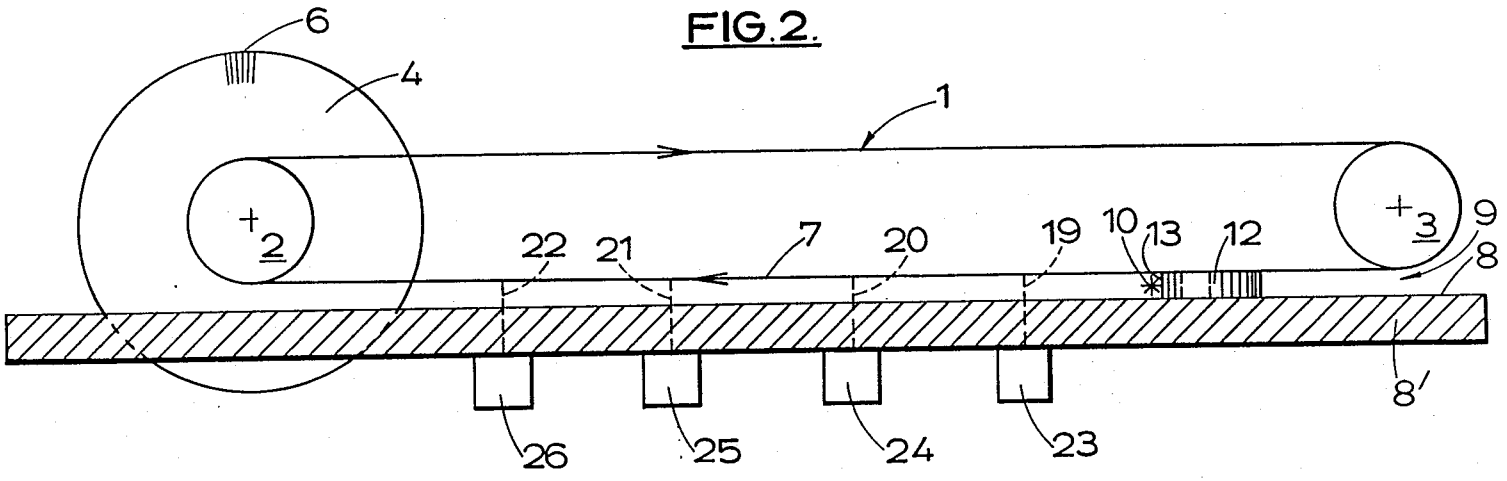
FIG. 2 is a schematic vertical cross-section of the sorter on the line 2—2 of FIG. 1.
Figure 1:
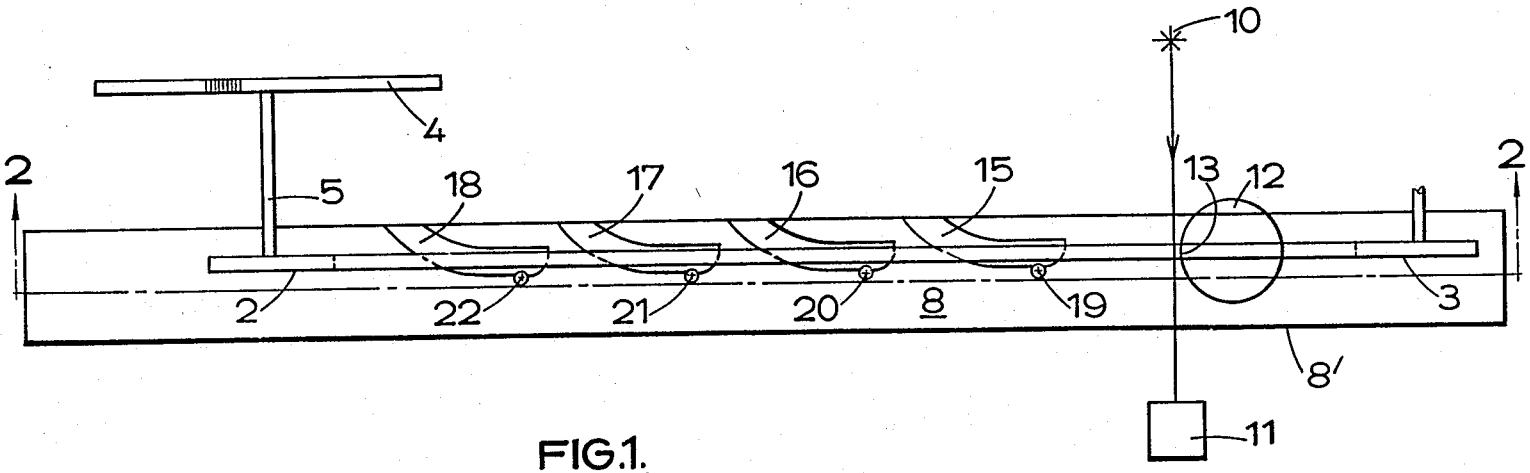
FIG. 1 is a schematic plan view of the coin sorter.

With reference to FIGS. 1 and 2, a flexible but substantially inextensible belt 1 extends around two pulleys 2 and 3, one pulley 2 of which is fast with the disc 4 of a short encoder on a common shaft 5. Either pulley 2 or 3 is driven by a suitable motor.

A suitable material for the belt is polyurethane reinforced by Kevlar (Trade Mark). In order to minimise changes in the speed of the belt a motor having a high inertia rotor is to be preferred, which may be of the external rotor type.

Disc 4 of the shaft encoder is provided in conventional manner with a continuous series of slits 6, only a few shown in FIG. 1, through which a light shines to provide a pulse signal on rotation of the disc. A typical suitable shaft encoder is the Hewlett Packard two channel incremental optical encoder HEDS-5000 series.

The lower run 7 of the belt is arranged closely adjacent to a horizontal, stationary coin support surface 8 of an elongate plate 8' on which the coins can freely slide. Surface 8 can be of, for example, stainless steel, ceramic, or graphite-impregnated nylon.

The lower run 7 of the belt intermediate the pulleys 2, 3 is urged towards the surface 8 by a series of suitable spring means, not shown, to ensure that adjacent coins of different thicknesses are each gripped by the belt.

A suitable coin feeding mechanism, not shown, is positioned adjacent to pulley 3 and arranged to feed, in known manner, mixed coins in single file and spaced apart into the bite 9 so that they are frictionally gripped by the belt 1 and slid along surface 8. The coin feeding mechanism could be of the well known disc type.

The use of the encoder signals as a basis for measuring the diameters of coins will now be described, but it sould be understood that, if desired, the coins may be tested in other ways.

As shown in FIG. 1, an infra-red diode 10 is positioned to one side of the belt 1 and slightly above surface 8. The diode 10 is directed horizontally at an infra-red detector 11 similarly positioned such that the path of infra-red light between the diode 10 and detector 11 is horizontal, transverse to the path of the coins 12 and at about the mid-height of a smallest coin to be measured, thereby ensuring that the beam of infra-red light will be broken by all coins which are carried by the belt along surface 8.

The signals from the detector 11 are used to gate pulses from the shaft encoder, the leading edge 13 of the coin causing a fall in the level of infra-red light detected by detector 11 which fall is used to open the gate, and the trailing edge of the coin produces a rise in the detected light which rise is used to close the gate. Provided that there is no slipping of belt 1 relative to the encoder disc 4, the number of pulses let through by the gate will correspond to the distance that the belt 1 has travelled whilst the coin 12 is passing the detector 11, and so the pulse count is an accurate representation of the coin diameter. The amount of the pulse count is used to control suitable coin deflecting means arranged to direct coins to different batching locations, as will be described hereafter.

It will be appreciated that since the infra-red beam passes transversely of the belt 1, the precise transverse position of the coin 12 relative to the belt does not matter with this measuring technique, and therefore that, other than surface 8, no datum surface is required. This is distinct from prior art coin discriminators, and is a considerable advantage when compared with other detectors which require datum surfaces. Damaged coins which rest against a datum edge give false readings with existing machines.

The coin deflecting means comprises a series of coin deflecting recesses 15, 16, 17, 18 formed in surface 8 and having associated respective coin deflecting pins 19, 20, 21, 22 actuated by respective solenoids 23, 24, 25, 26 mounted beneath plate 8'. For conenience only four sets of coin deflecting recesses have been shown in FIGS. 1 and 2, but in practice any number of recesses can be provided to suit the number of coin denominations to be sorted, the length of the plate 8' and belt, being chosen accordingly. Typically nine recesses are provided.

The shape and action of the coin deflecting recesses will now be described with reference to FIGS. 3 to 5 which show a typical recess 15. For convenience the recesses 15, 16, 17 and 18 are made of identical shape and size. Recess 15 is of substantially hockey stick or j-shape, comprising a straight limb portion 27 extending parallel to the belt 1 and tangentially contiguous with a part-circular, curved deflection portion 28 which diverges from the belt path.

The retractable pin 19 associated with recess 15 is reciprocable in the reduced diameter upper portion 29 of a bore extending through plate 8' normal to surface 8, the lower bore portion 30 of the bore being adapted to receive a locating spigot, not shown, on the upper end of the respective solenoid 23 which actuates pin 19.

Figure 3:
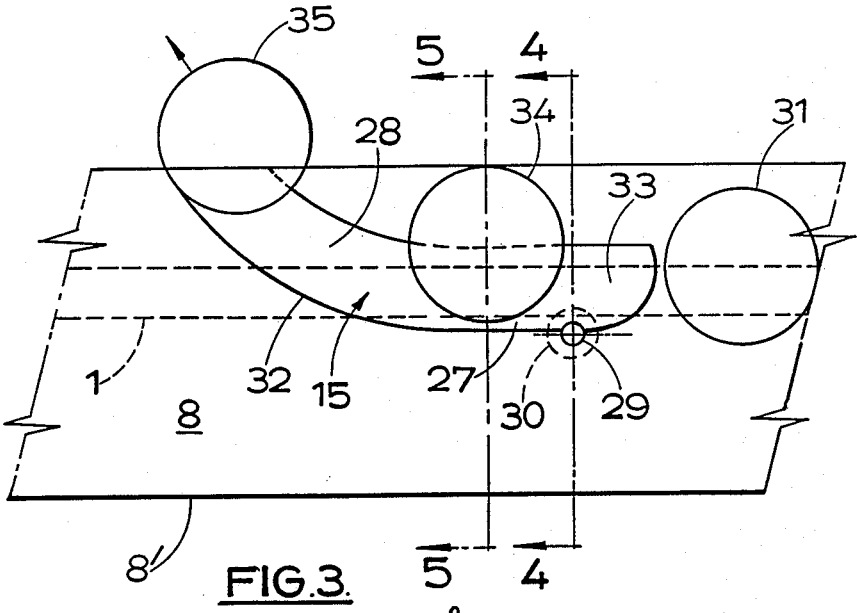
FIG. 3 is an enlarged plan view of a portion of the coin sorter showing the precise shape of one of the identical coin deflecting recesses.

The coins approaching the series of deflection recesses are roughly positioned transversely of plate 8', as coin 31 in FIG. 3, by suitable guide means such that in the absence of intervention by one of the pins 19–22, the coins would straddle the straight limb portions 27 of the deflection recesses as they are carried along the surface 8 by belt 1. Pin bore portion 29 breaks through edge surface 32 of recess 15, as shown in FIG. 4, such that when pin 19 is projected above surface 8 by solenoid 23 a coin 31 will be deflected by pin 19 such that the coin is not able to straddle the recess portion 27.

Figure 4:
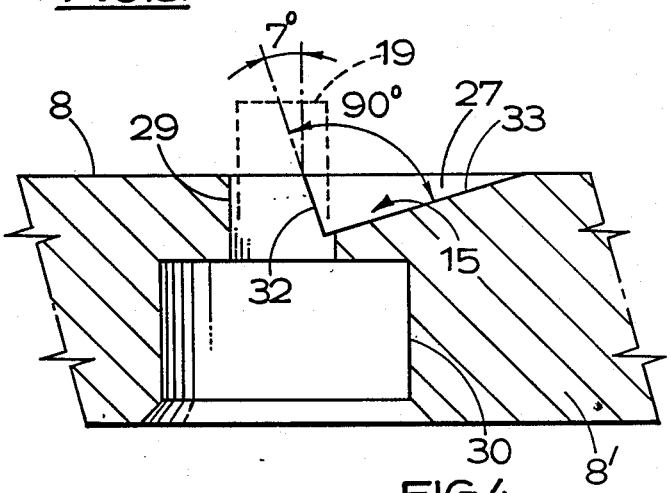
FIG. 4 is a cross-section on the line 4—4 of FIG. 3 but on a yet larger scale.
Figure 5:
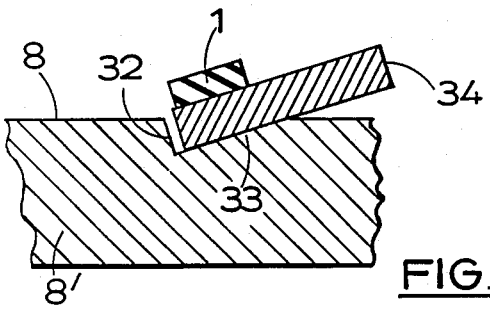
FIG. 5 is a similar cross-section but on the line 5—5 of FIG. 3.

As shown in FIG. 4 the recess 15 is defined by edge surface 32 and basal surface 33, the surfaces 32 and 33 subtending a right angle, and the surface 32 being inclined at an angle of 7° to the normal to surface 8. The reason for the inclination of surfaces 32 and 33 to surface 8 is to accommodate a tilted coin, as demonstrated by the coin 34 in FIGS. 3 and 5. The coin 34 has been selected for deflection by the recess 15, and accordingly the pin 19 has been projected to the position indicated in FIG. 4, to move the coin transversely of the plate 8' so that it cannot straddle the recess portion 27 and the coin 34 has been tilted into the recess by the belt 1, under the force of spring pressure on the belt.

As the coin is carried along recess 15 by belt 1 engagement of the coin with the curved portion of edge surface 32 will provide the force for deflecting the coin transversely of the belt, and the coin will leave plate 8' in the direction indicated in FIG. 3 by the arrow on coin 35 from where it will fall into a suitably positioned collection chute, not shown, associated with the recess 15. Thus edge surface 32 constitutes a deflection wall.

It will be appreciated that the collision of a coin with the projected pin 19 will tend to slow down the coin, but that the frictional engagement of the belt 1 with the coin will assist in maintaining its speed in the direction of the belt path.

The pins 19 to 22 can be of tool steel, and the solenoids 23 to 26 are chosen to have a fast response time.

The general operation of the coin sorter will now be described. A coin 12 approaching the coin deflection recesses 15 to 18 is tested by the discriminator 10, 11, or by some other discriminator/s positioned in advance of the recesses. The discriminator signal is compared with suitable reference values held in a memory which are appropriate to the different kinds of coins to be sorted. The comparison will determine which of the recesses 15 to 18 is to be used to deflect the coin from plate 8'. It is then necessary for the software to operate the deflection pin associated with that recess at the time that the particular coin is about to reach that recess.

It should be appreciated at this point that, in order to handle a large number of coins in a minimum time, several coins will be proceeding in file along the table 8' at the same time, and it is therefore important that a deflection pin is not projected prematurely. Accordingly it is necessary to track the progress of a coin along the surface 8, and the shaft encoder 4, 6 provides the signals for this. Since the distances along surface 8 between the discriminator 10, 11 and the deflection pins 19 to 22 are known, and since the coins travel substantially without slipping relative to the belt, the encoder readings provide an accurate record of the coin position along surface 8. Suitable software monitors the progress of all of the coins that have passed the discriminator 10, 11 and initiates the projection of the appropriate deflecting pin above surface 8 just prior to the respective coin reaching the appropriate deflection recess.

It will be appreciated that the encoder reading is noted at the moment that the coin is first detected by the coin discriminator 10, 11, and then a target count of the encoder signals is computed from the determination of coin denomination, and the pin is operated. when the actual count from the encoder reaches the target count.

In the case of some coin discriminations of some currencies there can be two coin types having completely different physical characteristics. Since the operation of the deflecting pins and deflection recesses does not depend upon the mechanical characteristics of the coin, it is possible to program the sorter such that both types of coin of the same denomination are deflected by the same deflection recess.

We claim:

1. A coin sorter comprising a support surface, a coin transport belt extending in proximity to said surface for carrying coins trapped between said belt and said support surface along said surface, a belt drive, means for feeding coins in serial manner to said belt, first and second locations along the path of said belt, a coin measuring means positioned at said first location for providing a coin identification signal, an encoder associated with said belt drive for providing an encoder output signal representative of the position of a portion of said belt along said path, at least one selectively operable coin deflection means located at said second location which is positioned downstream of said first location, said control means being arranged such that, in response to a coin identification signal from said coin measuring means that requires the coin to be deflected at said second location by said deflection means, said deflection means is arranged to be active when the coin reaches said second location as determined from detecting the occurence of a predetermined change in said encoder output signal subsequent to said coin passing said coin measuring means.

2. A coin sorter as in claim 1 wherein said coin deflection means comprises a deflection wall bounding a recess in said support surface of a depth such that a coin when in said recess is still substantially driven by said belt, said deflection wall being shaped to deflect a coin which is engaged with said deflection wall out of said belt path to a coin receiving means and a selectively operable transverse positioning means for transversely positioning selected coins arriving at said recess, whereby selected coins can be pressed into said recess by said belt for deflection by said deflection wall.

3. A coin sorter as in claim 2 wherein said selectively operable transverse positioning means is located at said recess.

4. A coin sorter as in claim 2 wherein said positioning means comprises a projection which is retractable below said support surface.

5. A coin sorter as in claim 4 wherein said projection is a pin which is retractable substantially normally of said support surface by a solenoid.

6. A coin sorter as in claim 2 wherein said support surface is provided with a plurality of such recesses arranged in series along said path, and a respective transverse positioning means is associated with each recess.

7. A coin sorter as in claim 6 wherein each recess is of substantially wedge-shape in transverse cross-section and of substantially hockey stick shape as viewed in plan.

8. A coin sorter as in claim 6 wherein said control means comprises reprogrammable means for enabling the destinations of different coin types in the sorter to be altered.

9. A coin sorter as in claim 1 wherein said coin measuring means is responsive to signals from said encoder which are used as a basis for measuring the diameter of a coin.

10. A coin sorter comprising a belt which is arranged in proximity to a support surface, means for feeding coins to said belt in single file, the arrangement being such that when said belt is driven the coins are trapped between said belt and said support surface and are carried along said support surface by the frictional engagement between said belt and the coins, a coin measuring means for measuring coins as they are conveyed by said belt along said support surface, a coin receiving means positioned alongside said support surface, the support surface being provided with at least one recess of a depth such that a coin when in the recess is still driven by the belt, the recess being bounded by a deflection wall which is shaped to deflect a coin which is engaged with said deflection wall out of the path of said belt to said coin receiving means, selectively operable positioning means positioned downstream of said coin measuring means and upstream of said recess for selectively displacing said coins transversely of the belt in response to said coin measuring means, whereby selected coins are positioned transversely of said belt such that they are pressed into said recess by said belt for deflection by said deflection wall.

* * * * *